United States Patent [19]

Knecht

[11] 4,007,976

[45] Feb. 15, 1977

[54] ELECTRICAL CONNECTORS

[75] Inventor: George W. Knecht, Brooklyn, N.Y.

[73] Assignee: Midland-Ross Corporation, Cleveland, Ohio

[22] Filed: Jan. 15, 1976

[21] Appl. No.: 649,395

Related U.S. Application Data

[62] Division of Ser. No. 530,061, Dec. 6, 1974, Pat. No. 3,971,609.

[52] U.S. Cl. ..... 339/14 RP; 339/75 P

[51] Int. Cl.[2] ..... H01R 3/06

[58] Field of Search ..... 339/14 RP, 75 P, 89 R, 339/89 M, 176 R

[56] References Cited

UNITED STATES PATENTS 3,345,603 10/1967 Cohen ..... 339/176 R

*Primary Examiner*—Roy Lake
*Assistant Examiner*—DeWalden W. Jones
*Attorney, Agent, or Firm*—H. Duane Switzer

[57] ABSTRACT

An electrical connector including selective polarization keying between the ground pin contact and ground socket contact. A rotatable sleeve around the ground socket contact selectively locks the ground pin contact in position or prevents insertion thereof when a circuit breaker is on.

3 Claims, 12 Drawing Figures

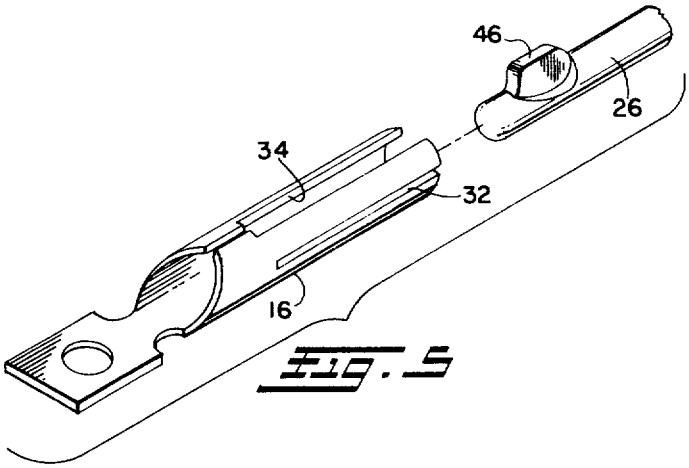
Fig. 5
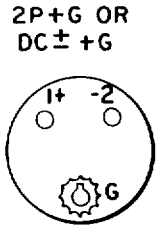
Fig. 7
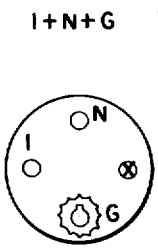
Fig. 8
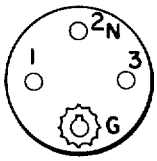
Fig. 9
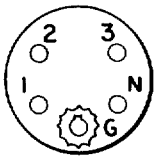
Fig. 10
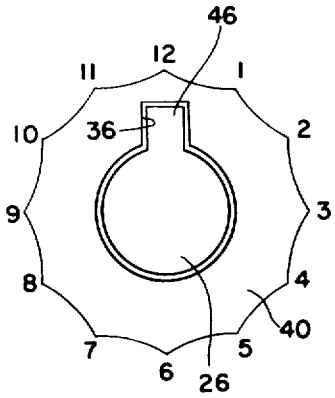
Fig. 11
| POL. POS. | 2P+G DC± +G | 1+N+G | 3P+G 2P+N+G | 3P+N+G | COLOR CODE |
|---|---|---|---|---|---|
| 1 | 208V 60HZ | 118V 60HZ | 3Ø 208V 60HZ | 3ØY 118/220V 60HZ | RED |
| 2 | 250V 60HZ | 125V 60HZ | 3Ø 250V 60HZ | 3ØY 125/250V 60HZ | GREEN |
| 3 | 440V 60HZ | ——— | 3Ø 440V 60HZ | 3ØY 250/440V 60HZ | GRAY |
| 4 | 480V 60HZ | 277V 60HZ | 3Ø 480V 60HZ | 3ØY 277/480V 60HZ | BLUE |
| 5 | 600V 60HZ | 347V 60HZ | 3Ø 600V 60HZ | 3ØY 347/600V 60HZ | YELLOW |
| 6 | 130V DC | ——— | 125/250V 60HZ | | WHITE |
| 7 | 250V DC | | | | ORANGE |
| 8 | | | | | |
| 9 | | | | | |
| 10 | | | | | |
| 11 | | | | | |
| 12 | | | | | |
Fig. 12

ELECTRICAL CONNECTORS

This is a division of application Ser. No. 530,061 filed Dec. 6, 1974, now U.S. Pat. No. 3,971,609.

BACKGROUND OF THE INVENTION

This application relates to electrical connectors and, more particularly, to electrical connectors with polarization keying.

Electrical connectors are manufactured in many different voltage ratings. Connecting male and female connectors having different voltage ratings from one another can seriously damage equipment or injure a person making such connection. Therefore, keys are commonly provided for preventing connection of male and female connectors having different voltage ratings. Such arrangement for preventing connection of male and female connectors having different voltage ratings is commonly referred to as polarizing, and connectors having such keying are often referred to as polarized connectors.

Polarized connectors of the type described have used the male and female grounding terminals as the means of polarizing. This is normally accomplished by the use of special cross-sectional shapes for such grounding terminals, such as L, J or U.

Other polarized connectors have keys which are separated from grounding terminals and such keys are located in different rotated positions for connectors having different voltage ratings. Having the polarization keying separate from the grounding terminals makes the connectors expensive to manufacture, and the male or female connector can be used only with another special male or female connector.

Many electrical connectors in use do not have any polarization keying. In changing over from connectors which do not have polarization keying, it is desirable that the changeover be accomplished in such a manner that plugs on exisiting equipment can be used with a new polarized socket. With such an arrangement, plugs on existing equipment and fixtures could be phased-out over a period of time without requiring great expense to immediately replace them.

It is a principal object of the present invention to provide an improved electrical connector having polarization keying.

A further object of the invention is to provide such a connector wherein existing male connectors can be used with a polarized female connector constructed in accordance with the invention.

An additional object of the invention is to provide a polarized eletrical connector which is very simple and inexpensive to manufacture, and simple to install and maintain.

A further object of the invention is to provide such a polarized connector which is very easy to understand by users in the field.

BRIEF DESCRIPTION OF THE DRAWING

FIG. 5 is a perspective illustration showing an electrical ground socket contact and an electrical ground pin contact;

FIG. 6 is a perspective illustration showing an electrical ground socket contact surrounded by a locking sleeve which locks a pin in the socket contact when a circuit breaker is on and prevents insertion of the pin contact when the circuit breaker is on;

FIG. 7 is an end view of an electricl connector having one voltage rating;

FIG. 8 is an end view of an electrical connector having another voltage rating;

FIG. 9 is an end view of an electrical connector having another voltage rating;

FIG. 10 is an end view of an electrical connector having another voltage rating;

FIG. 11 is an enlarged end view showing a portion of an electrical connector having the improved polarizing arrangement of the present invention incorporated therein; and FIG. 12 is a table illustrating examples of voltage and phase assignments for the connectors of FIGS. 7—10.

DESCRIPTION OF A PREFERRED EMBODIMENT

Figure 1:
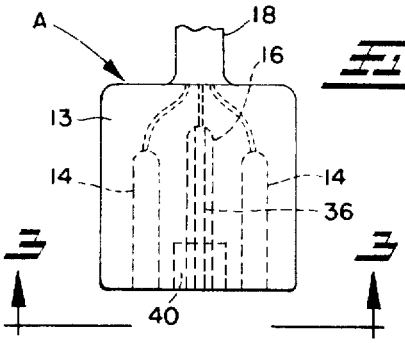
FIG. 1 is a plan view of a female electrical connector constructed in accordance with the present invention.

Referring now to the drawing, wherein the showings are for purposes of illustrating a preferred embodiment of the invention only and not for purposes of limiting same, FIG. 1 shows a female electrical connector A which includes a body member 13 of rubber or plastic material having a plurality of spaced socket electrical contacts 14 and a ground socket contact 16 spaced from electrical contacts 14. Such contacts are suitably connected with wires extending through cord 18 in a known manner.

Figure 2:
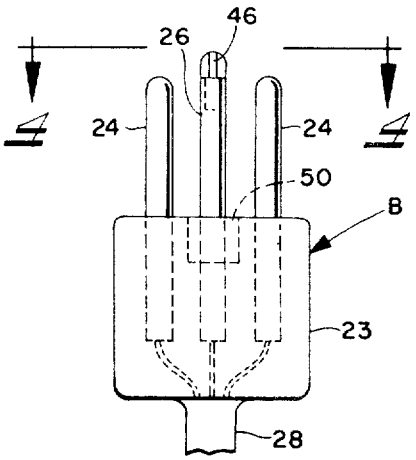
FIG. 2 is a plan view of a male electrical connector constructed in accordance with the present invention.

Male electrical connector B of FIG. 2 includes a body member 23 having a plurality of spaced-apart electrical contact pins 24 and a ground contact pin 26 spaced from electrical contact pins 24. Contacts 24 and 26 are suitably connected with electrical wires extending through cord 28 in a known manner. Ground pin 26 has a length which is substantially greater than the length of electrical contact pins 24 so that electrical contacts 14 and 24 will not be engaged until after engagement of ground contacts 16 and 26.

Figure 3:
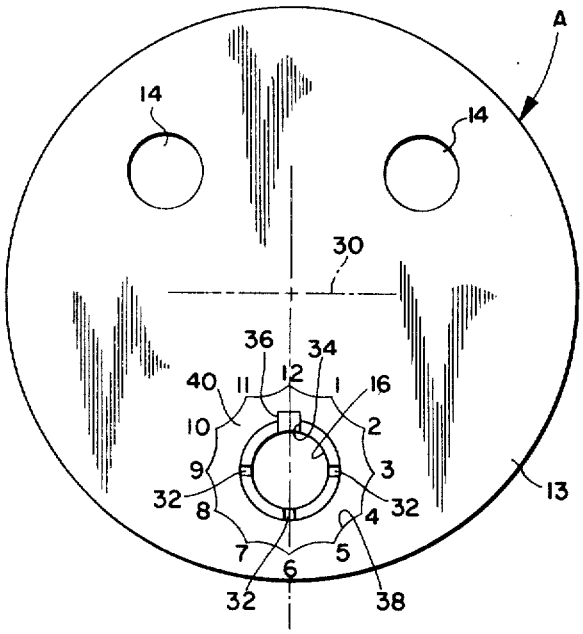
FIG. 3 is an end view looking generally in the direction of arrows 3—3 of FIG. 1.

As shown in FIG. 3, contacts 14 and 16 lie on the periphery of a circle having its center coincidental with the longitudinal axis 30 of body member 13. Ground socket contact 16 comprises a generally cylindrical metal member having circumferentially-spaced longitudinally extending slits 32 which extend less than the full length thereof to provide a resilient gripping action when a pin is received therein. Ground socket contact 16 includes a larger longitudinal slot 34 which is aligned with a keyway groove 36 in body member 13.

In one arrangement, body member 13 is molded or otherwise formed with a polygonal socket 38 therein. In the arrangement shown, such socket has the shape of a dodecagon, although it will be appreciated that other polygonal shapes can be used. An insert member 40 has a cross-sectional peripheral shape and size corresponding to that of socket 38 so that insert 40 can be located in any of twelve different rotated positions relative to socket 38 and such positions are indicated by numerals 1—12. In the specific arrangement shown in FIG. 3, slot 34 and keyway groove 36 are located at position 12, and it will be recognized that such slot and groove can be located in alignment with one another at any of the other eleven positions. A different aligned position for such slot and groove is used for electrical connectors having different voltage ratings. Instead of using an insert 40, it will be recognized that groove 36 can be formed integrally in body member 13 by molding or machining. When ground socket contact 16 is assembled to body member 13 or molded therein, it is positioned so that large slot 34 will be aligned with the position of groove 36.

Figure 4:
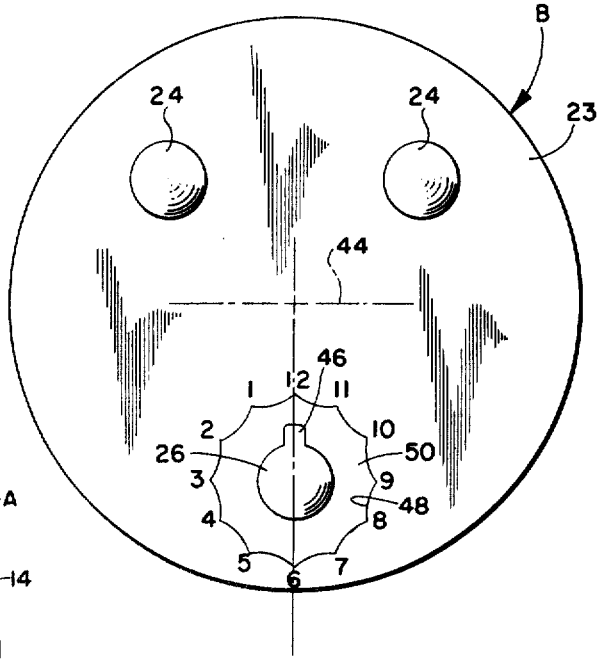
FIG. 4 is an end view looking generally in the direction of arrows 4—4 of FIG. 2.
Figure 6:
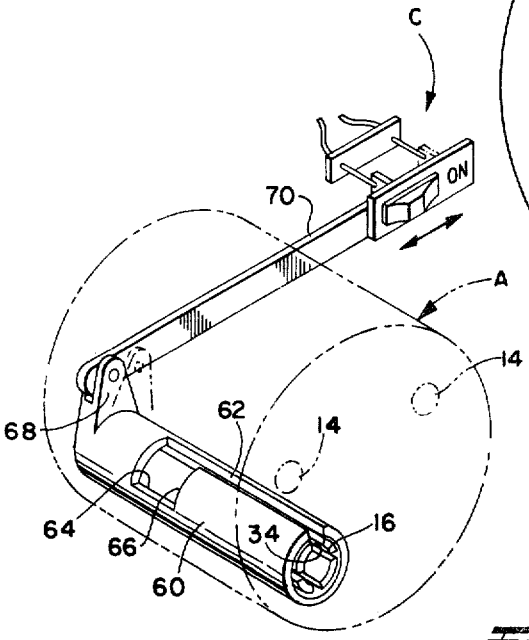

As shown in FIG. 4, contacts 24 and 26 lie on the periphery of a circle having its center coincidental with the longitudinal axis 44 of body member 23. Such circle is of the same diameter as the circle on which socket contacts 14 and 16 are located so that pins 24 will be receivable in socket 16. Pin 26 has a generally cylindrical cross-sectional shape for tight reception in contact 16 and includes an enlarged key 46 extending generally radially outwardly from the longitudinal axis thereof for reception in socket slot 34 and keyway groove 36.

In one arrangement, body member 23 has a polygonal socket 48 therein for receiving a polygonal insert 50. In the arrangement shown, the socket and insert have the cross-sectional shape of a dodecagon. However, it will be recognized that other polygonal shapes can be used. With the dodecagon shape, insert 50 can be received in any of twelve different positions in socket 48. Each of such twelve positions are numbered counterclockwise in FIG. 4 as opposed to the clockwise numbering of FIG. 3. For male and female connectors having the same voltage rating, key 46 is located in the same position as keyway groove 36 and slot 34. Therefore, a male connector having a given voltage rating will mate only with a female connector having the same voltage rating. For male and female connectors having different voltage ratings, keyway groove 36 will be located in a different position from key 46 so that mating cannot occur. Instead of using insert 50 in socket 48, it will be recognized that pin 26 can be assembled or molded into body member 23 in other ways for locating key 46 in a selective number of different circumferential positions.

FIG. 5 is a perspective illustration showing how the polarized ground socket and pin mate with one another. It will be recognized that ground socket 16 can be rolled into the cylindrical shape from flat stock, or can be machined or formed from extruded tubing. Ground pin 26 may be solid and have key 46 coined adjacent the outer end thereof. However, it will be recognized that key 46 may be a separate member welded or otherwise secured to pin 26, and pin 26 can also be hollow. In the preferred arrangement, key 46 has a very short length compared to the length of pin 26 and is located closely adjacent the outer end thereof. However, it will be recognized that key 46 may also extend substantially the full length of pin 26. In the preferred arrangement shown, body portions 13 and 23 have cylindrical cross-sectional shapes, although it will be recognized that other shapes can be used. Inserts 40 and 50 can simply be a tight fit in their respective sockets, or can be glued or otherwise secured therein.

In accordance with another aspect of the invention, locking means is provided adjacent ground contact 16 in body member 13 for locking ground pin 26 therein. In one arrangement, such locking means comprises a generally cylindrical sleeve member 60 rotatably surrounding ground socket 16. Sleeve 60 has a generally L-shaped slot therein including a longitudinally-extending main slot leg portion 62 alignable with slot 34 in ground socket 16, and a rear lateral slot leg portion 64 extending transversely of main slot leg portion 62 to provide an abutment shoulder 66. In one arrangement, sleeve 60 has a rear connecting ear 68 which is suitably connected by a mechanical linkage 70 with circuit breaker C which is movable between on and off positions. Linkage 70 connects sleeve 60 an circuit breaker C in such a manner that main slot leg portion 62 in sleeve 60 is aligned with slot 34 in ground contact 16 only when circuit breaker C is off. When circuit breaker C is on, slots 62 and 34 are out of alignment with one another so that pin 26 cannot be received in ground socket 16 because key 46 will abut against the outer edge of sleeve 60. This prevents mating of female and male electrical connectors when circuit breaker C is on. Once pin 26 has been received in ground socket 16, movement of circuit breaker C to its on position rotates sleeve 60 to trap key 46 behind abutment shoulder 66 so that the electrical connectors cannot be separated while circuit breaker C remains on. This prevents arcing of the electrical contacts because the male and female electrical connectors cannot be mated or separated while the electrical current is on.

For purposes of example only, FIGS. 7—10 show end views of different male or female electrical connectors. The legend below each figure explains how the connector can be wired. For example, the legend for FIG. 7 indicates that the connector may be wired with two poles plus ground, or with DC plus or minus and plus ground. The connector of FIG. 8 may be wired with one pole plus neutral plus ground. The legends below the other figures are self-explanatory. The table of FIG. 12 gives examples of different voltage and phase assignments with reference to the arrangements of FIGS. 7—10. For example, with keyway groove 36 and key 46 located for mating in circumferential polarity position 1, the voltage and phase assignment for the different connectors may be as indicated in FIG. 12. For other circumferential polarity positions of groove 36 and key 46, other voltage and phase assignments may be used as shown in the table. Obviously, other assignments for voltage and phase may be used, and more polarity positions than those given by way of example may be utilized.

With the polarizing arrangement described, it will be recognized that existing male electrical connectors having cylindrical ground pins without a key 46 can be used with a polarized female electrical connector of the present invention. This makes it possible to phase out nonpolarized connectors by first replacing only the female connectors.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

I claim:

1. An electrical connector socket comprising; a body member having a plurality of spaced-apart socket electrical contacts and a socket ground contact spaced from said electrical contacts, said ground contact including a sleeve member having a longitudinal slot therein, a keying groove in said body member aligned with said slot, locking means adjacent said ground contact for locking a ground pin therein, and said locking means including a sleeve member rotatably surrounding said ground contact and having a generally L-shaped slot therein including a main slot leg alignable with said ground contact slot and a rear lateral slot leg extending transversely of said main slot leg.

2. An electrical connector socket comprising; a body member having a plurality of spaced-apart socket electrical contacts and a ground socket contact spaced from said electrical contacts, said ground socket contact including a sleeve member having a longitudinal slot therein, a keying groove in said body member aligned with said slot, and selectively movable locking means movably carried by said body member adjacent said ground socket contact for selective movement between locking and unlocking positions for selectively releasably locking a ground pin in said ground socket contact.

3. The connector of claim 2 wherein said locking means moves between said locking and unlocking positions for respectively preventing insertion or removal of a ground pin relative to said ground socket contact and permitting insertion or removal of a ground pin relative to said ground socket contact.

* * * * *